US006795974B1

(12) United States Patent
Howell

(10) Patent No.: US 6,795,974 B1
(45) Date of Patent: Sep. 28, 2004

(54) KNEELING PAD WITH CANTILEVERED KNEECUP

(76) Inventor: Bret L. Howell, 5222 N. Vincent Rd., Newman Lake, WA (US) 99025

( * ) Notice: Subject to any disclaimer, the term of this patent is extended or adjusted under 35 U.S.C. 154(b) by 25 days.

(21) Appl. No.: 10/612,437

(22) Filed: Jun. 30, 2003

(51) Int. Cl.[7] ..... A41D 13/00
(52) U.S. Cl. ..... 2/22
(58) Field of Search ..... 2/22, 23, 24, 62, 2/242, 455, 911, 16; 128/881, 882; 602/16, 26, 25, 62

(56) References Cited

U.S. PATENT DOCUMENTS 1,931,524 A * 10/1933 Becket ..... 2/22
4,409,689 A * 10/1983 Buring et al. ..... 2/22
5,297,294 A * 3/1994 Washick ..... 2/22
5,561,857 A * 10/1996 Hoshizaki et al. ..... 2/22
5,652,956 A * 8/1997 Hoshizaki et al. ..... 2/22
6,178,555 B1 * 1/2001 Williams ..... 2/22
6,637,034 B1 * 10/2003 Worden ..... 2/24

* cited by examiner

*Primary Examiner*—Tejash Patel
(74) *Attorney, Agent, or Firm*—Maxwell C. Freudenberg; Kenton L. Freudenberg

(57) ABSTRACT

A kneeling pad assembly having an articulated supporting spine assembly with an upper spine member carrying a protected cushioned kneecup and a lower spine member carrying a shin engaging cushion. The pad assembly is supported on the leg of a user only by a pair of leg straps extending from the lower spine member behind the user's leg below the knee. The upper spine member is cantilevered above the lower spine and is constructed to be pivotally moveable with a snap action between two stable positions. The first stable position is with the upper spine collinear with the lower spine to hold the cushioned kneecup against the user's knee. The second stable position is with the upper spine member angled away from the user's leg at an acute angle to the lower spine member to hold the kneecap out of contact with the user's knee to avoid discomfort and displacement of the kneeling pad assembly during standing or walking.

21 Claims, 13 Drawing Sheets

47
11
47
43
42
51
45
41
40
44
47
42
55
12
50

11
41
A
40
12

KNEELING PAD WITH CANTILEVERED KNEECUP

FIELD OF THE INVENTION

The invention relates to a cushioning and protecting kneeling pad assembly to be secured to a leg with fastening straps located only below the knee.

BACKGROUND OF THE INVENTION

There are a great variety of both vocational and avocational activities in which a person is required to spend a lot of time in a kneeling position with most of the body weight supported on the knees, but with frequent movement to a crouching or standing position for required mobility. Movements of the person among these positions has historically presented problems of discomfort in the attachment of kneeling pad devices to the legs as well as frequent misadjustment of the kneeling pad devices requiring inordinate attention for readjustment. Kneeling pad devices typically have a cup-shaped portion covering the front, sides and top of the knee with plural straps to hold the kneeling pad to the leg. Walking movement after reaching an erect position from a kneeling position usually presents significant annoyance and/or discomfort due to interference between the knee and the cup-shaped portion as the leg repeatedly flexes at the knee. Most of the various prior art articulated knee protecting devices have failed to provide a simple relief of these problems without requiring some support between the knee pad and the leg at or above the location of the knee. Also, the components of prior art devices are typically sewn, riveted or otherwise secured together, thus precluding replacement of worn or damaged parts.

SUMMARY OF THE INVENTION

Various deficiencies of the prior art are overcome by achieving the following objects of this invention in accordance with the ensuing summary and detailed descriptions of various embodiments of the invention.

It is an object of the invention to provide a pad for protection of knees when kneeling which is readily attached and adjusted on the leg and which comprises a plurality of quick-detachable separable structural shaping and cushioning ventilated layers.

Another object of the invention is to provide a comfortable kneeling pad which encloses the front, sides and top of the knee to protect it from external forces and debris when the user is kneeling and crawling.

Another object of the invention is to provide an articulated kneeling pad assembly with a knee-protecting cup portion wherein the assembly is supported entirely by leg engaging fasteners located only below both the knee and the cup.

Another object of the invention is to provide an articulated kneeling pad assembly having an elongated lower spine or support member which is secured along the front of the shin of the user by appropriate fasteners with all other parts of the kneeling pad assembly supported from this lower spine.

A still further object of the invention is to provide an articulated kneeling pad assembly with a knee-protecting cup portion wherein the cup portion during use has a knee-conforming shape but wherein the cup portion is movable to a position spaced from the knee when the user stands erect and remains spaced from the knee to minimize discomfort or annoyance during standing or walking.

A further object of the invention is to provide a kneeling pad assembly wherein the knee-protecting cup portion comprises an upper spine or support member connected just below the knee by an articulated connecting joint to the upper end of the elongated lower spine support member.

Another object of the invention is to provide between the upper and lower spine members an articulated hinged connecting joint structure having a hinge axis extending transversely across the upper end of the elongated lower spine support member in front of the user's shin.

Another object of the invention is to provide two selectable adjusted positions of the upper spine member relative to the lower spine member, a first position in which the kneecup engages the knee and a second position in which the kneecup is spaced from and out of contact with the knee.

Another object of the invention is to provide cooperating abutment surfaces on the upper and lower spine members which collide to restrict the movement of the upper spine member relative to the lower spine member to the range between the first and second positions.

A still further object of the invention is to provide cooperating detent surfaces on the upper and lower spine members whereby the upper spine member moves relative to the lower spine member to each of the first and second positions with a snap action to normally retain the upper spine member in such a respective position.

An object of the invention is to have a kneecup configuration whereby, upon rising from kneeling to standing positions, the rim of the cup is pushed by the upper leg of the user to move the kneecup from its first to its second position. However, if the user moves from kneeling to a sitting position on a stool or the like, the user can manually flip the upper spine member to its second position if desired. When moving to a kneeling position contact of the upper spine structure with the floor or other kneeling surface will assure that the upper spine will be in its first position with the kneecup in contact with and cushioning and protecting the knee.

In accordance with an alternative embodiment of the invention the kneeling pad assembly has a resiliently biased pad on an upper spine which is constructed to move away from the knee toward a spaced relationship with the knee when kneeling pressure on the pad is reduced upon raising the knee from its kneeling position. This biasing of the pad may be achieved by adding a biasing spring in the hinged joint between the upper and lower spine members.

Another alternative way of achieving this biasing force on the pad is to have the upper and lower spine members integrally molded in their angled relative positions with the molded angled connection self-biasing the pad toward a spaced position spaced from the knee when the user is not kneeling, the pad being retained in its other extreme position by a detent structure.

A further alternative way of achieving a self-biasing force on the pad is to have the upper and lower spine members integrally molded in collinear relative positions with the molded connection biasing the pad toward the knee, the pad being retained in its other extreme position by a detent structure.

In both the snap acting and the resiliently biased embodiments the upper spine member has a stable position corresponding to a position in which the spine holds the kneecup and pad spaced from the knee. In the snap acting version of the invention the detent configuration provides a bistable arrangement wherein the upper spine is pushed to or from each of the bistable positions where it is retained by respective detent structures.

DETAILED DESCRIPTION OF THE PREFERRED EMBODIMENT

Figure 1:
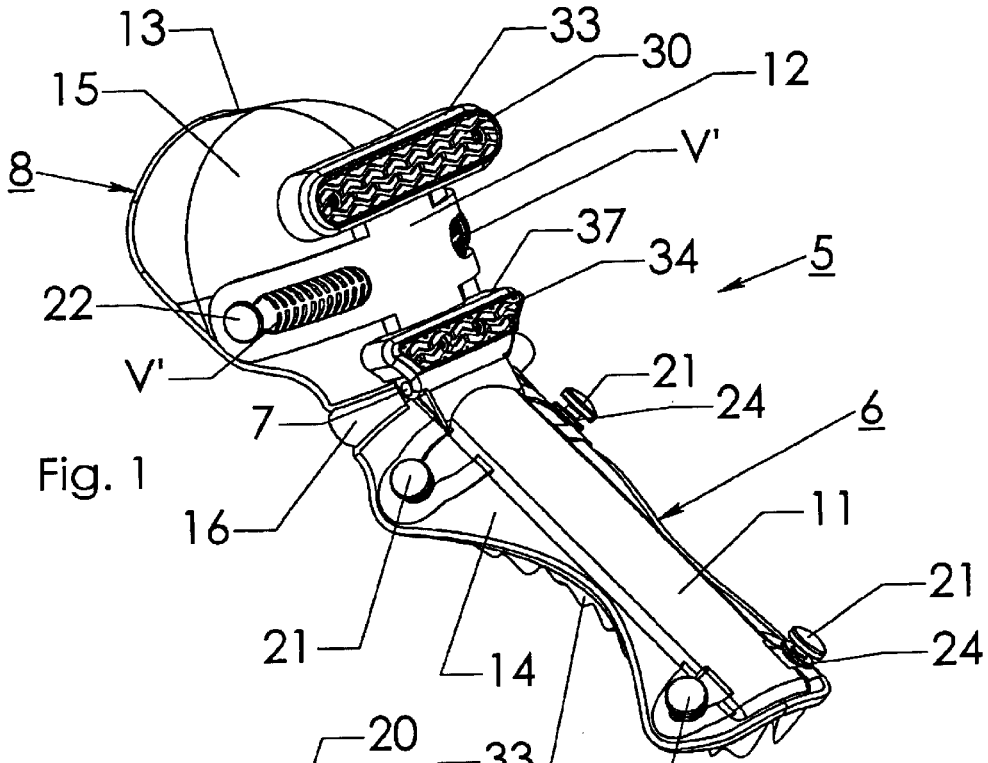
FIG. 1 is a front perspective view of a hinged kneeling pad assembly with a kneecup portion supported by an upper spine member which is forwardly articulated relative to a lower shin supported spine member with tread members attached to the front of the upper spine member
Figure 2:
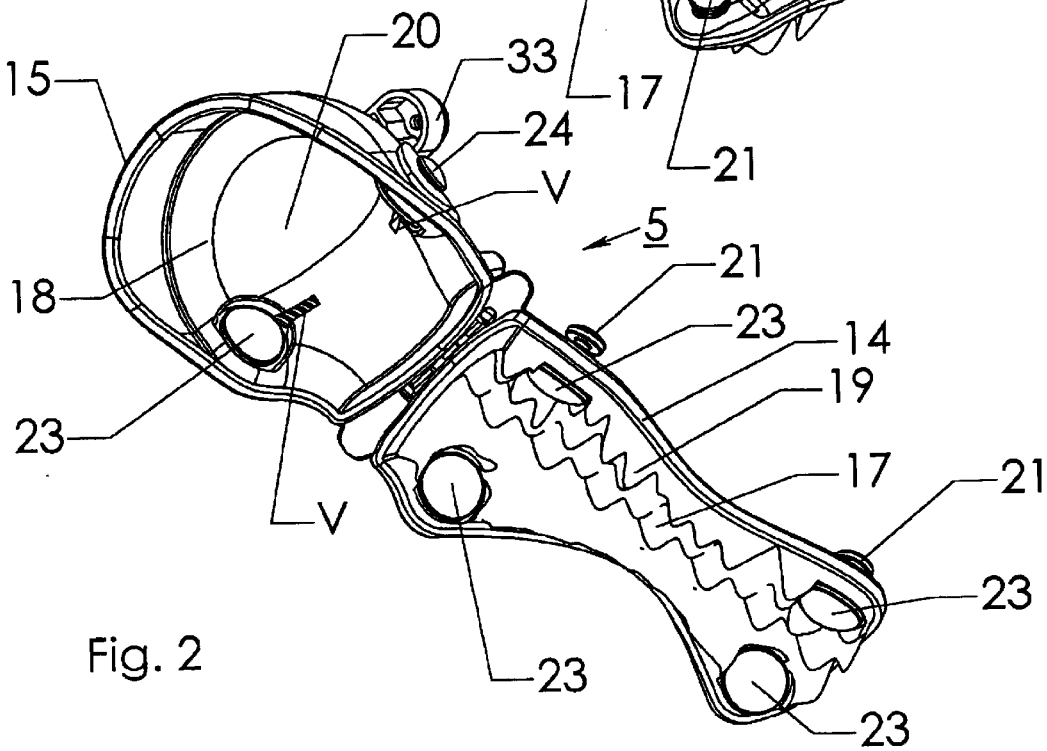
FIG. 2 is a rear perspective view of the kneeling pad assembly of FIG. 1.
Figure 4:
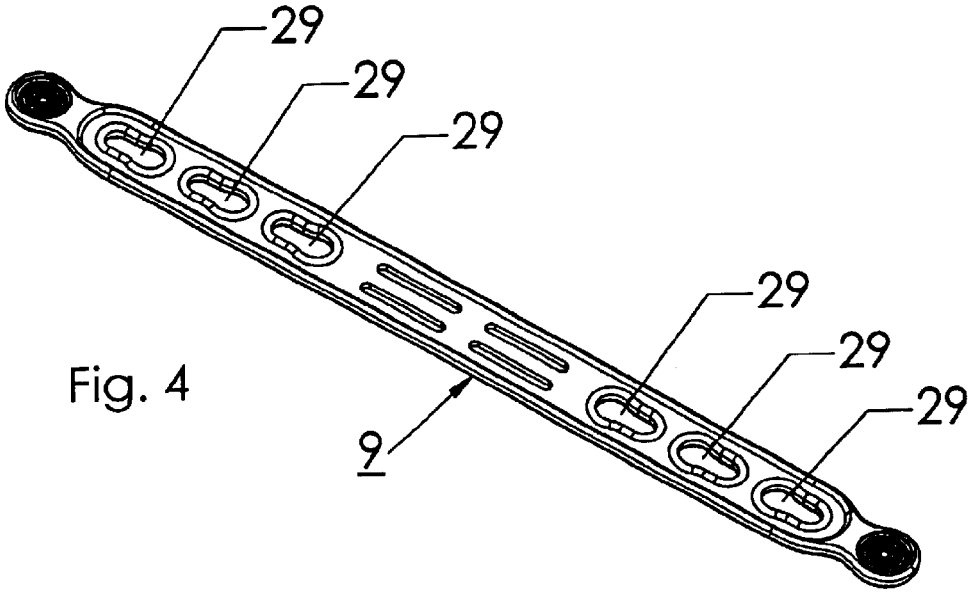
FIG. 4 is a perspective view of the strap of FIG. 3.
Figure 3:
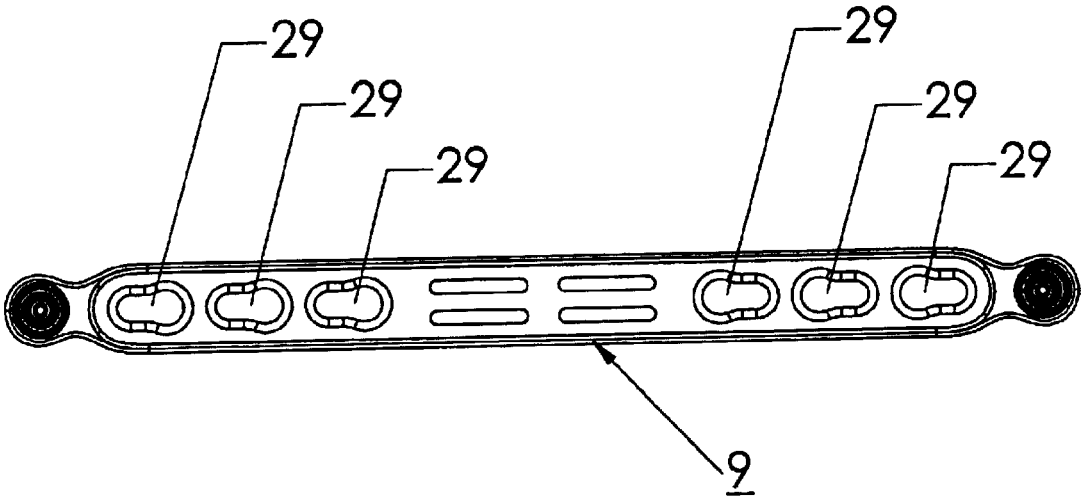
FIG. 3 is a plan view of one of two fastening straps used to secure the lower spine member to the shin of the user.

Referring to FIGS. 1–2, the preferred embodiment of the present invention includes a two-part relatively articulated or hinged kneeling pad assembly 5 having an elongated lower hinged assembly structure 6 hinged at hinge pin 7 to an upper hinged assembly kneeling cup structure 8. The lower structure 6 is intended to be secured below the knee along the front of a users's shin by adjustable elastic quick release straps 9 (FIGS. 3–4) and provides the only support for the upper kneecup structure 8 which in the position of FIGS. 1–2 is arranged to be held at an angle such that the kneecup structure 8 remains spaced from the user's knee.

An elongated spine member 11 is the principal supporting structural element of the lower assembly structure 6. A shorter spine member 12 is the principal supporting structural element of the upper assembly structure 8. Spine members 11 and 12 are hingedly interconnected by the hinge pin 7 which extends transversely across the top end of the spine member 11 below the user's knee.

The spline members 11 and 12 have surfaces adjacent the hinge pin 7 which collide or abut to provide means to limit the range of angular swinging motion movement of the spline member 12 relative to the spline member 11 to an acute angle of about 38 degrees between its extreme angular position as is reflected in FIGS. 1–2 and another position of spline member 12 which is collinear with spline member 11.

Figure 7:
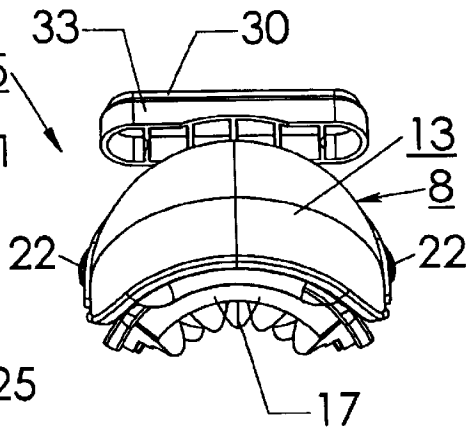
FIG. 7 is a top view of the kneeling pad assembly of FIG. 1.
Figure 6:
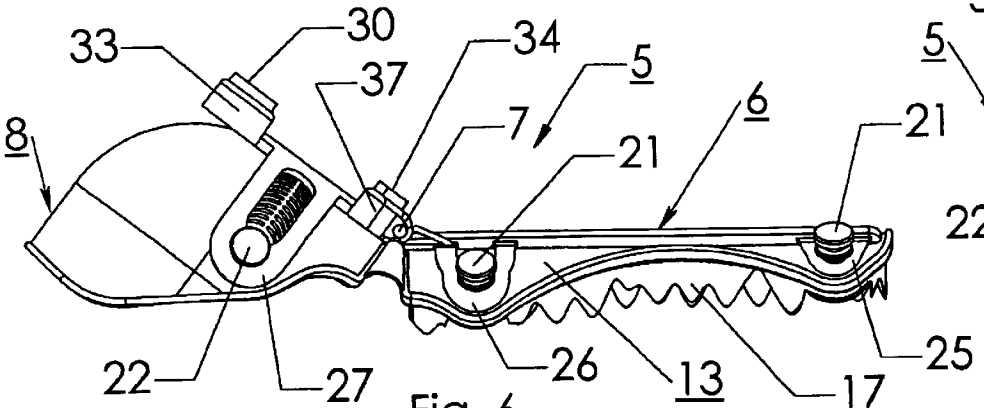
FIG. 6 is a side view of the kneeling pad assembly of FIG. 1.
Figure 5:
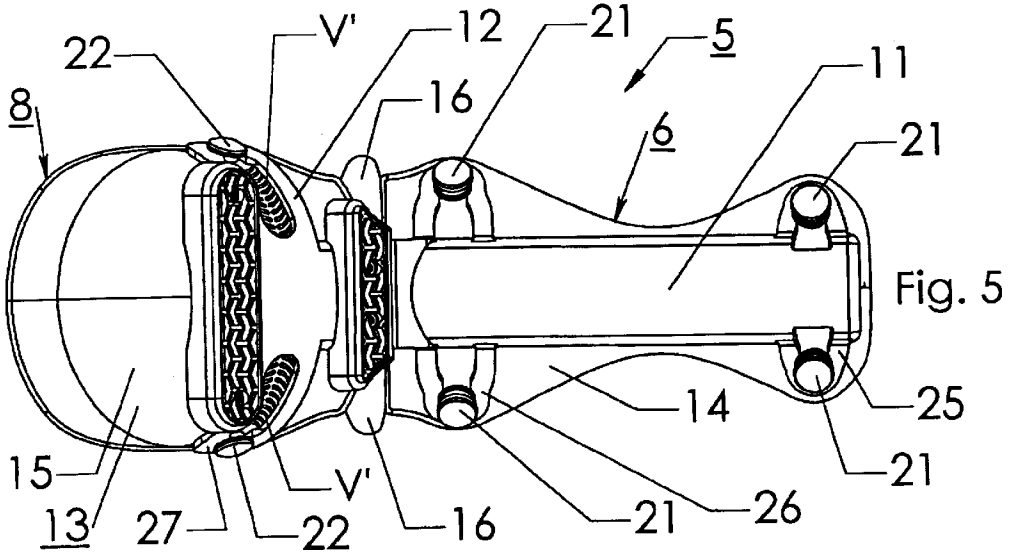
FIG. 5 is a plan view of the kneeling pad assembly of FIG. 1.

FIGS. 5–7 are orthogonal front, side and top views corresponding to FIG. 1.

Figure 8:
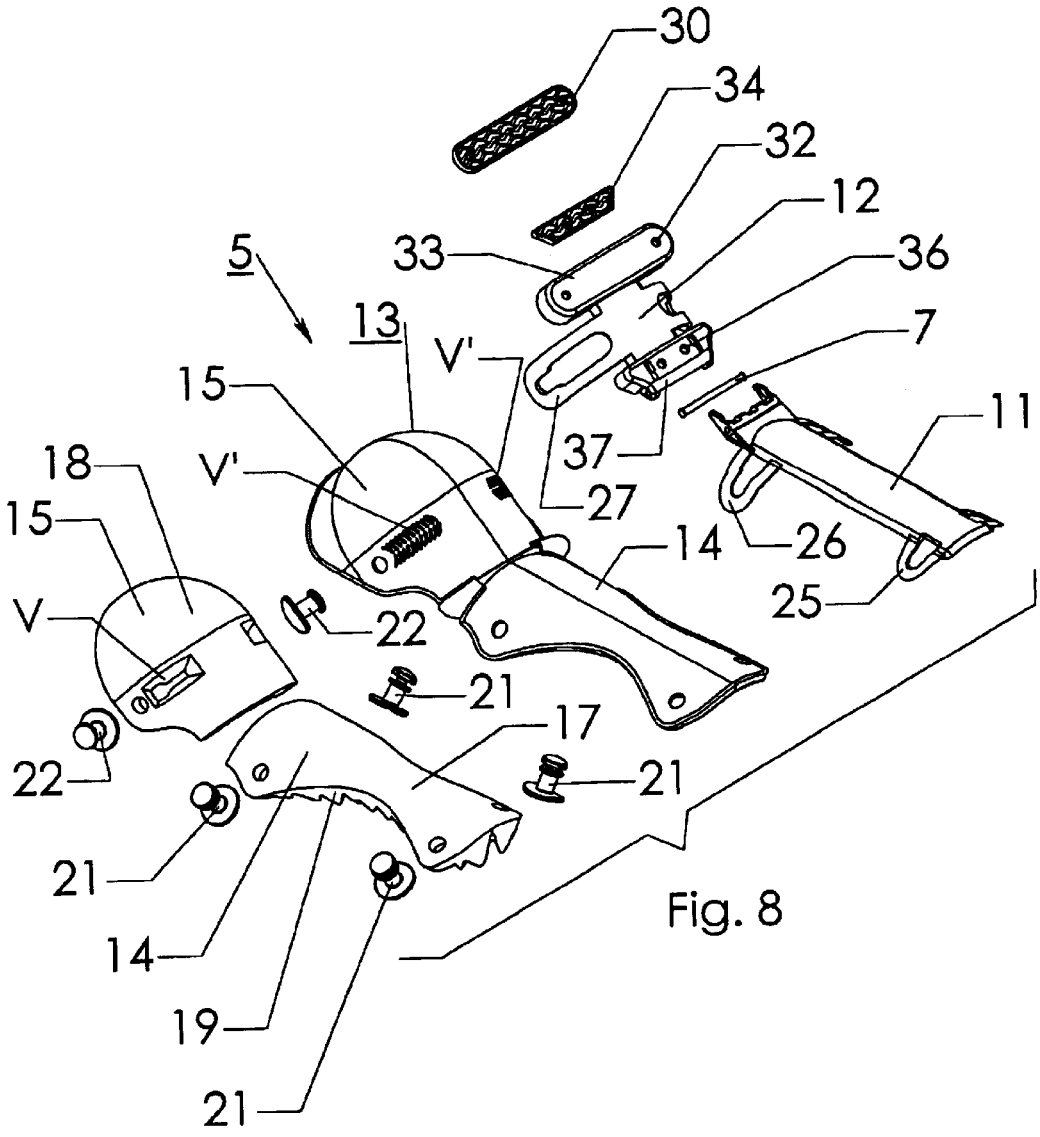
FIG. 8 is an exploded front perspective view of the components of FIG. 1.
Figure 9:
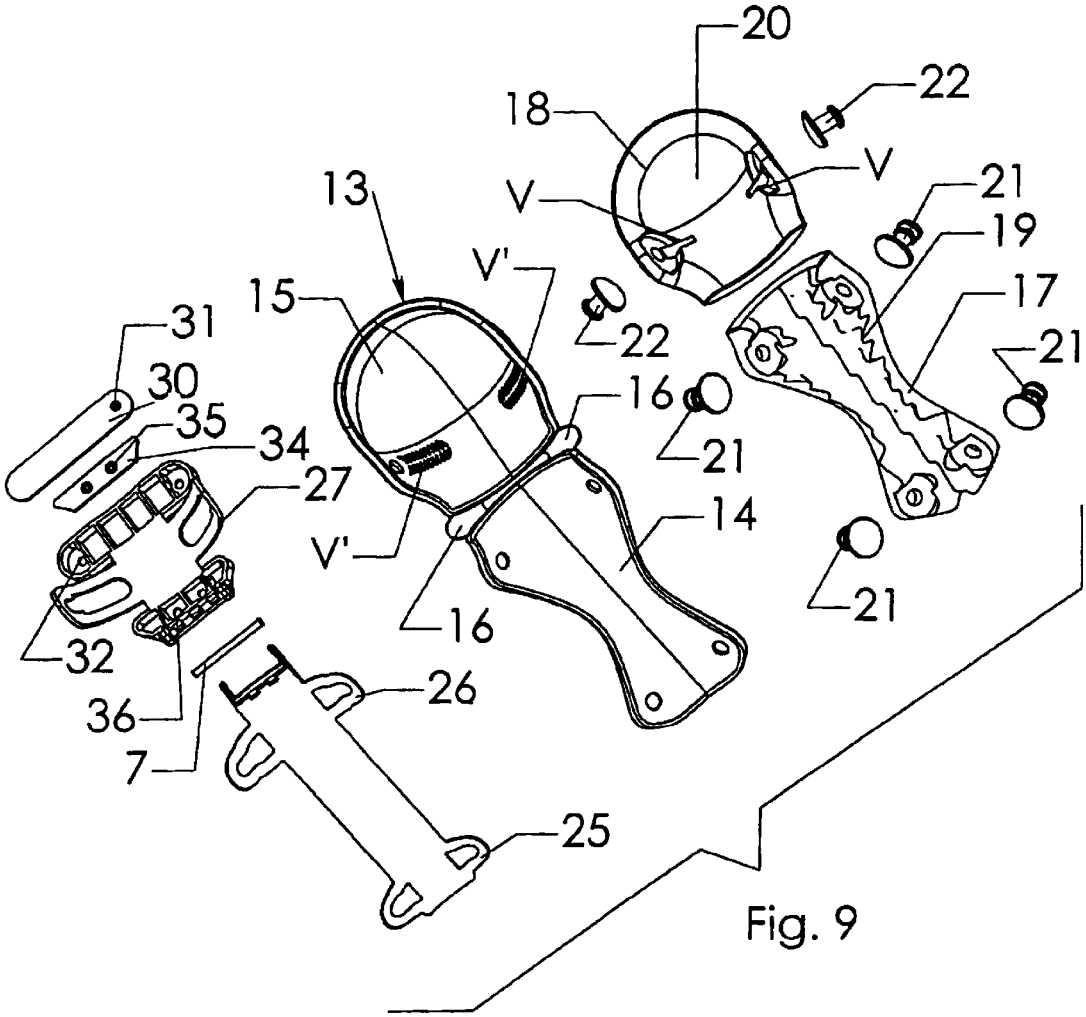
FIG. 9 is an exploded rear perspective view of the components of FIG. 1.

FIG. 8 is a front exploded view which helps to identify the shape of component parts of FIG. 1. FIG. 9 is a rear exploded view which helps to identify the shape of component parts of FIG. 2.

Both the lower assembly structure 6 and the upper assembly structure 8 each comprise closely layered spine members, shaping and shielding members and cushioning members. Adjacent the rear side of the hinged spine members 11 and 12 is an elongated flexible shaping and shielding member 13 having a lower shin shielding portion 14 extending the length of the spine member 11 and a cup-shaped upper shielding portion 15 at the upper spine 12 for shielding the knee. These shielding layer portions 14 and 15 are interconnected by an integral folded and pleated web portion 16 to permit relative flexing of the portions 14 and 15 as the kneeling pad assembly hinges between its extreme angular positions.

As seen more clearly in FIGS. 2 and 8 the inner surfaces of the shielding portions 14 an 15 are covered with cushioning layers 17 and 18 respectively. The inside face of the cushioning layer 17 in the shield portion 14 is covered over most of its surface with a plurality of spaced knobby projections 19 for comfortable contact with the user's shin. A central cushioning layer portion 20 of cushioning layer 18 in the shield portion 15 is configured to withstand the greater stresses imposed by the knee and has multiple ventilating apertures V aligned with multiple ventilating apertures V' in the shielding portion 15. The flexible shielding portion 15 extends a sufficient distance above the kneeling surface at the top and sides of the shielding portion 15 to prevent debris and dirt from entering the area of the cushion portion 20 during use of the kneepad assembly 5. The shielding portion is sufficiently stiff to enable the portion of the user's leg above the knee to push the knee cup structure 8 from its position in contact with the user's knee, with upper and lower spine members collinear, to its angled position (FIG. 1) when the user straightens his leg as when moving from a kneeling position to a standing position.

Figure 13:
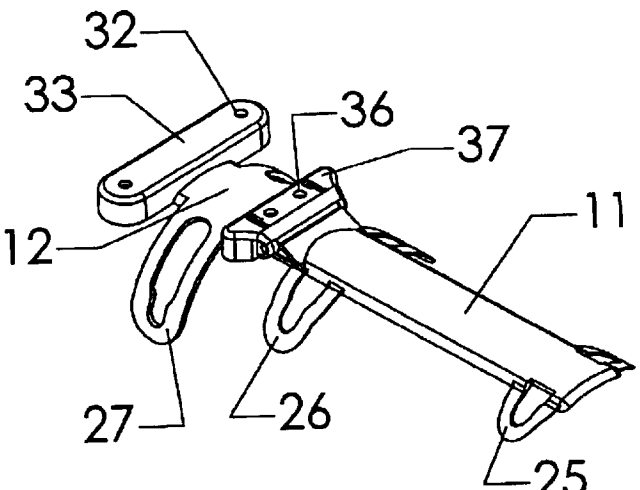
FIG. 13 is a front perspective view FIGS. 10–12.
Figure 11:
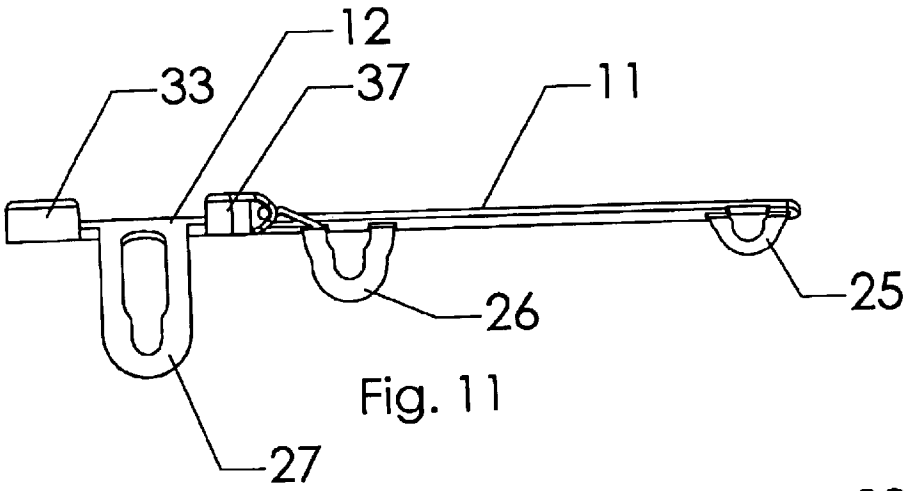
FIG. 11 is a side view of the part of the assembly of FIG. 3 but showing only the hinged upper and lower collinearly oriented spine members.
Figure 10:
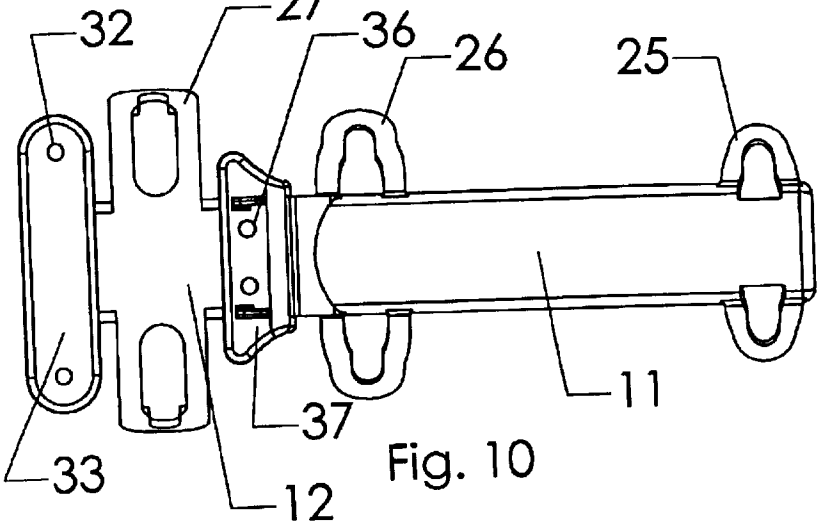
FIG. 10 is a plan view of the part of the assembly of FIG. 3, but showing only the hinged upper and lower collinearly oriented spine members.
Figure 14:
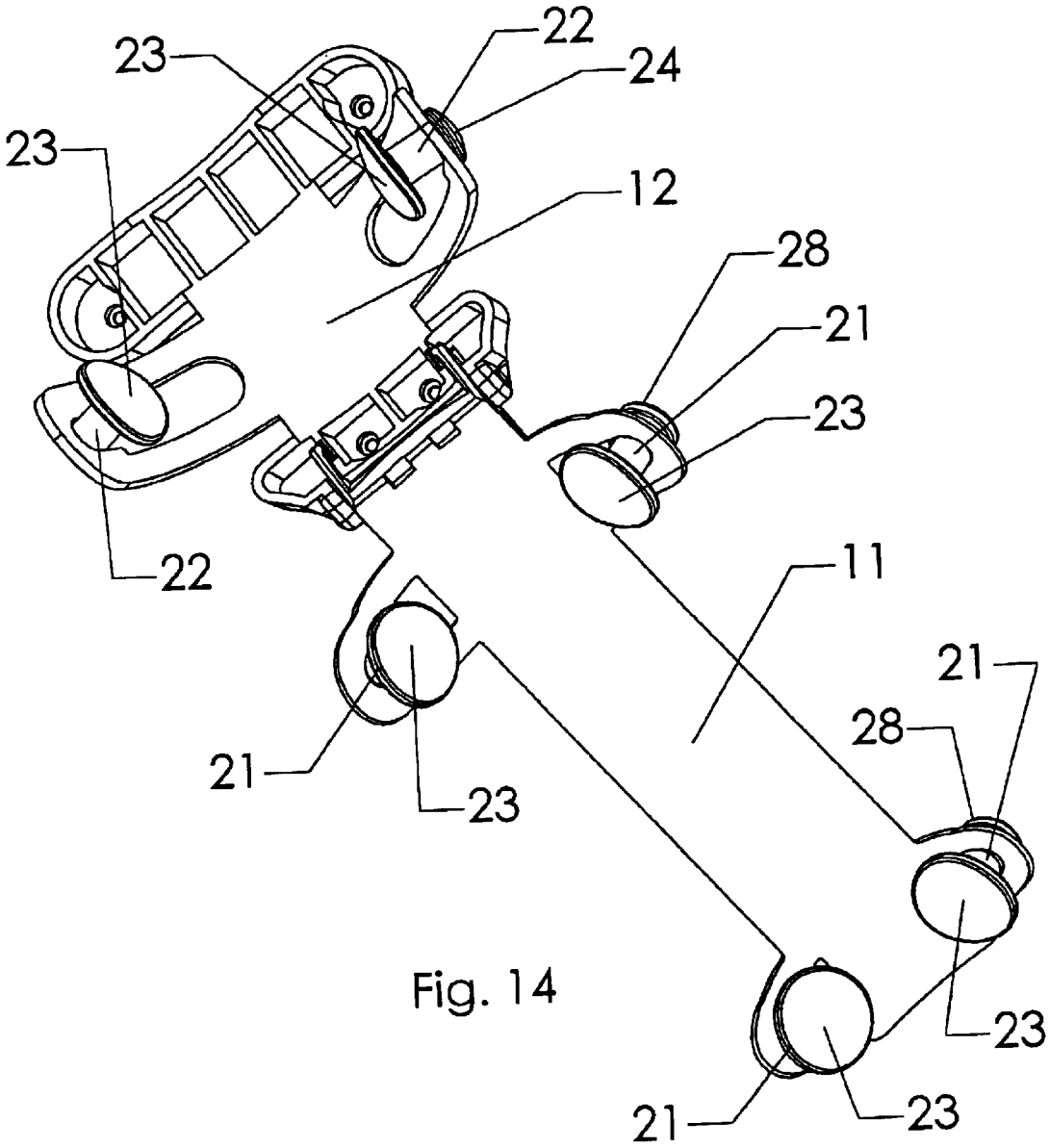
FIG. 14 is a rear perspective view of the spine assembly of FIG. 13 and showing relative positions of pins used to secure other parts of the kneepad assembly to the rear of the spine assembly.
Figure 15:
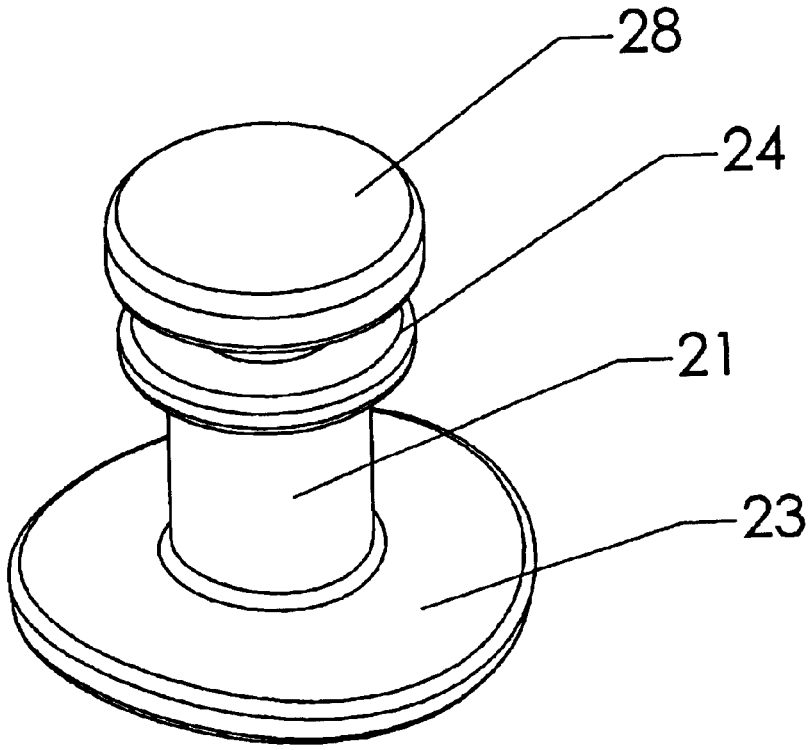
FIG. 15 is a perspective of one of the four pins used in FIGS. 1, 2, 5–9 and 14 to fasten shielding and cushioning parts of the kneeling pad assembly to the lower spine member along with the fastening straps of FIGS. 13–14.
Figure 16:
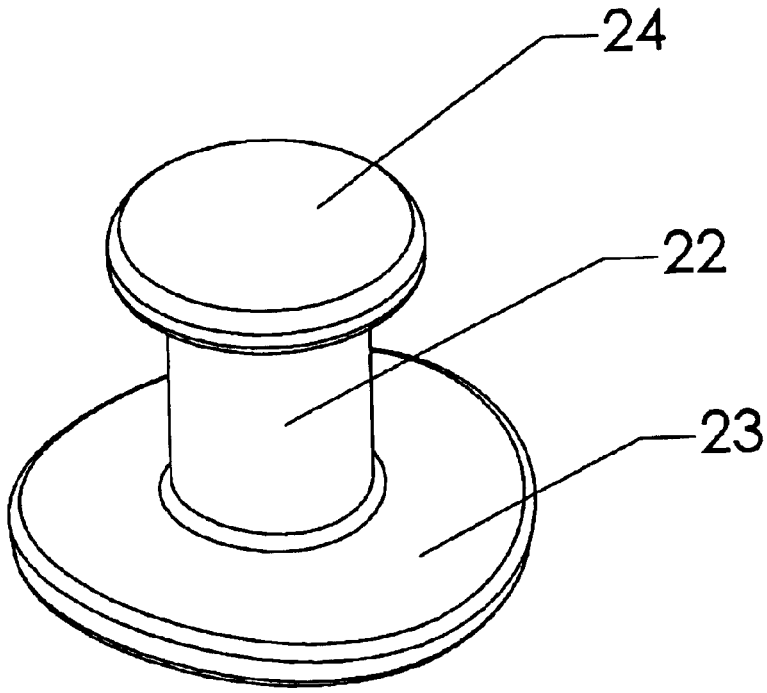
FIG. 16 is a perspective of one of the two pins used in FIG. 1–9 and 14 to fasten shielding and cushioning kneecap members on the upper spine member.

The shielding layers 13 and cushioning layers 17 and 18 are provided with apertures which accommodate the stem portions of the two pairs of fastening pins 21 (shown enlarged in FIG. 15) and one pair of fastening pins 22 (shown enlarged in FIG. 16). FIG. 2 shows the inside shouldered ends 23 of these pins embedded at spaced points in the cushioning layers 17 and 18 whereas FIG. 1 shows the outer ends of these pins with shoulders 24 held beneath pairs of buttonhole-like looped ends of thin and slightly elastic ears 25, 26 and 27 extending from the sides of the spine members 11 and 12. The pairs of pins 22 in the lower spine member 11 have further outboard shoulders 28 arranged to be held in selected buttonhole-like adjustment openings 29 in the quick-release straps 9 (FIGS.3–4) which extend around the calf of the user's leg to retain the lower assembly structure 6 of the kneeling pad assembly 5 in a fixed comfortable adjusted position below the user's knee. The strap openings 29 are readily manually slipped on and off the pin shoulders 28 to provide for quick attachment and detachment of the lower assembly structure relative to the user's leg. The configuration of pins 21 is shown in FIG. 13. The configuration of pins 22 is shown in FIG. 14.

As seen in FIG. 1, the upper spine carries a pair of tread members 30 and 34 having flat coplanar non-skid outer surfaces engageable with a flat kneeling surface to keep the kneeling pad assembly from rocking from side to side during kneeling use. The tread members 30 and 34 have parallel pin-like projections 31 and 35 on their sides opposite the tread surfaces, which projections are removably secured in holes 32 and 36 in projections 33 and 37 in the upper spine member 12.

Figure 12:
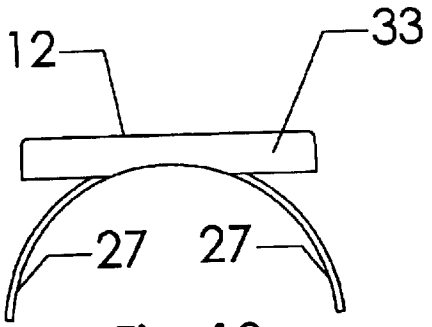
FIG. 12 is a top end view of part of the spine assembly of FIG. 11.
Figures 17, 17A:
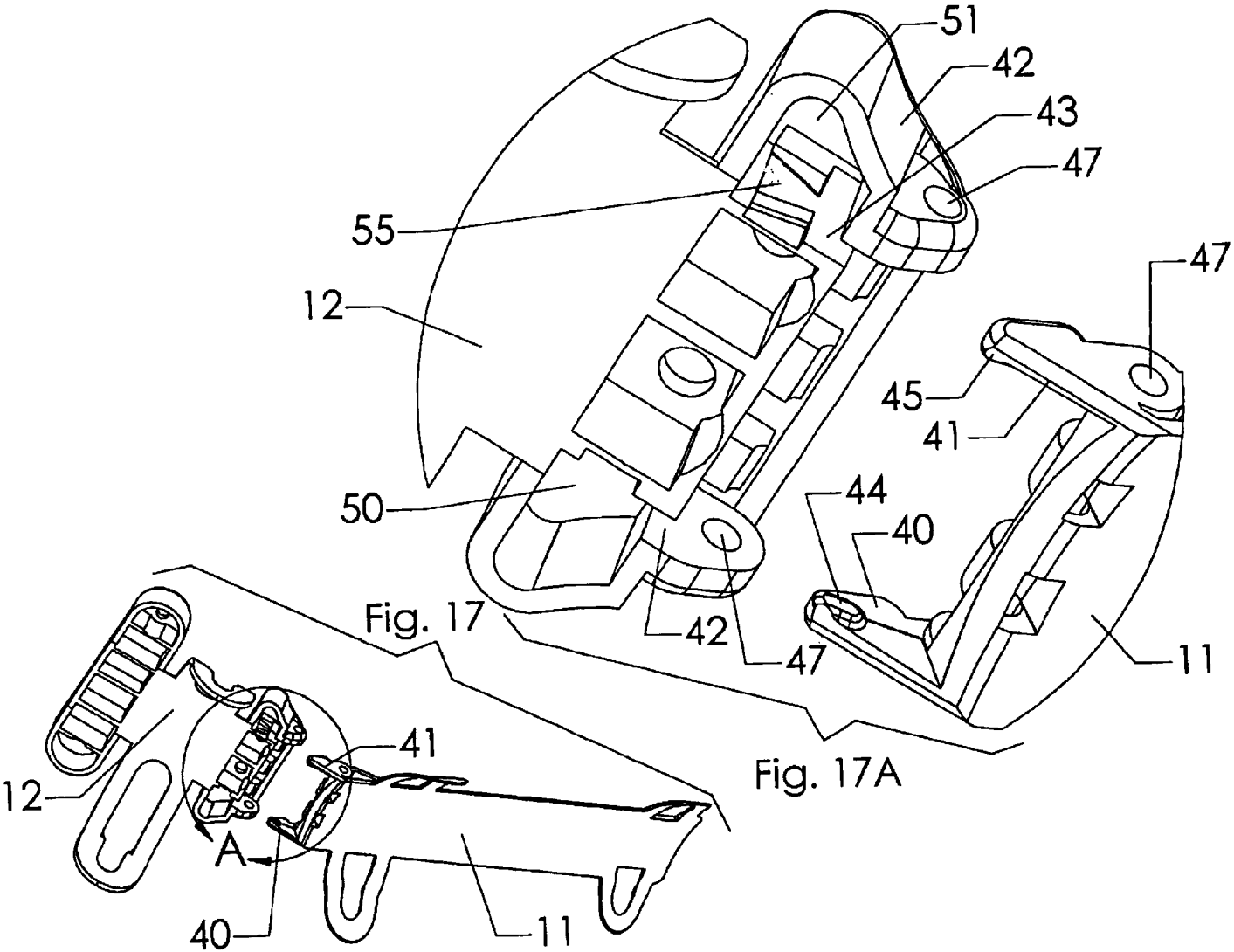
FIG. 17 is a rear exploded view of separated upper and lower spine members.
FIG. 17A is an enlarged portion of separated upper and lower spine members circled in FIG. 17 to more clearly illustrate detent structures interacting between the spine members.
Figure 18:
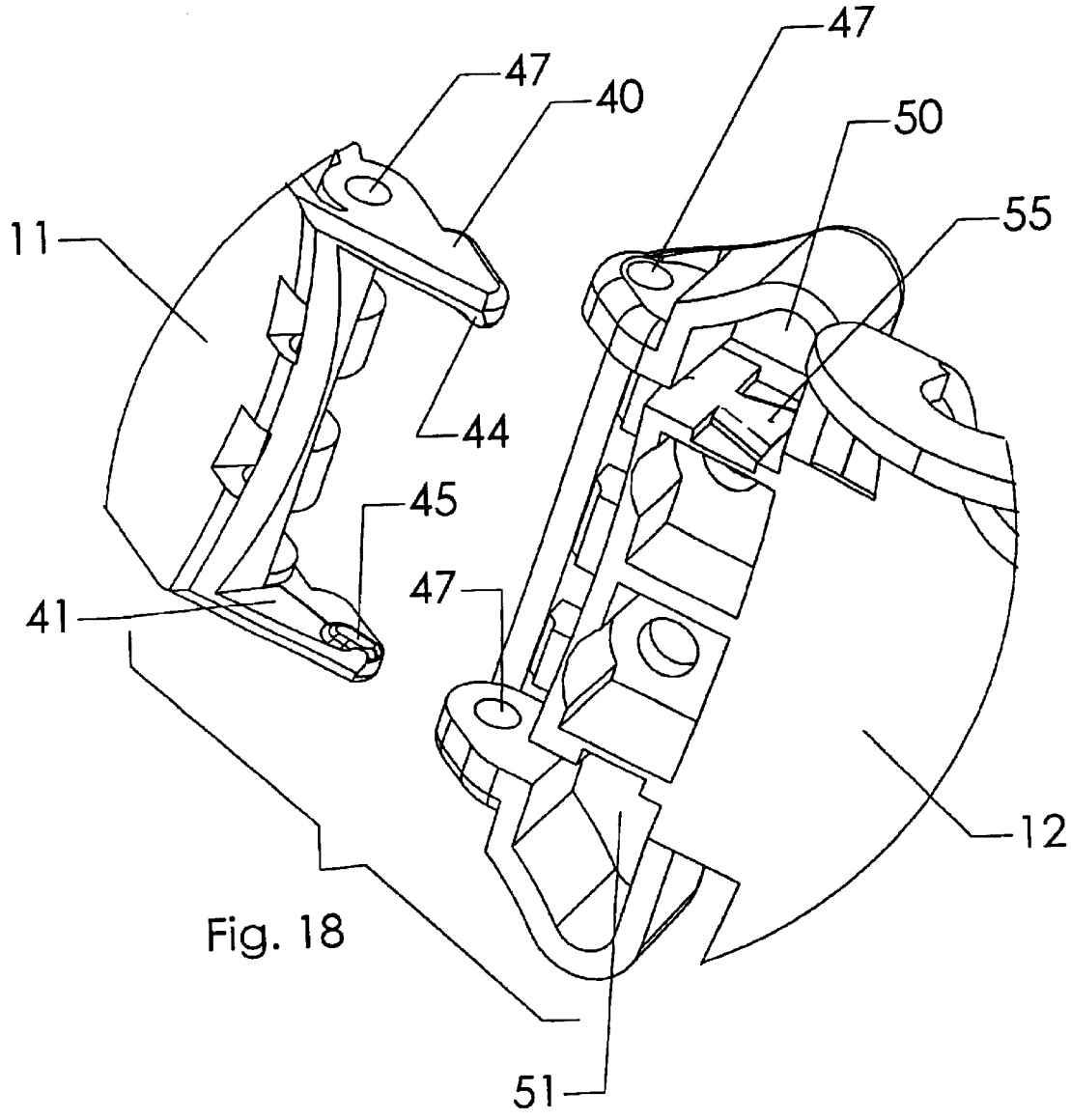
FIG. 18 is a perspective view similar to FIG. 17A but taken at a different angle.

In the exploded view of the lower and upper spine members 11 and 12 in FIG. 17, the slightly-resilient tip projections 40 and 41 on the lower spine member 11 are configured to extend in close fitting relationship into respective passages in the upper spine member 12. The circled area A of FIG. 17 is greatly enlarged in FIG. 17A to better illustrate small inwardly projecting protuberances 44 and 45 on the respective projections 40 and 41. In the assembled positions of the spine members 11 and 12, wherein the hinge pin 7 is inserted into coaxial hinge pin openings 47, the projecting resilient tips 40 and 41 are able to flex outwardly in the spaces 50 and 51 at the rear of the passages 42 and 43 as seen in FIG. 12A. The hinge pin 7 is fitted in the spine members 11 and 12 to maximize freedom of pivoting movement of spine 12 relative to spine 11. As the upper spine member moves in alternate directions between its extreme angular positions, the tip 41 flexes outwardly in space 51 permitting the protuberance 45 thereon to snap past an angular raised rib 55 on the upper spine member 12 in space 51. Thus the tip 41, protuberance 45 and rib 55 form a detent structure for holding the upper spine member 12 in either of its extreme positions. The tip 40, protuberance 44 and another mirror image rib 55 (FIG. 18) in space 50 define a second similarly functioning detent structure. Each detent structure forms two respective detents, located in each of the spaces 50 and 51, which detents are active, depending upon which side of the rib 55 is engaged by the corresponding protuberance 45 to hold the upper spine either in the first stable knee engaging position collinear with the lower spine or in the second stable position angled with respect to the lower spine to keep the upper spine spaced from the knee.

In the foregoing preferred embodiment detents located at one or both of the spaces 50 and 51 provide the entire means for selectively retaining the upper spine in either of its two stable positions and the upper spine is selectively forced by the user either manually or by alternately kneeling and standing to be alternatively moved between the two stable positions.

All of the components of the kneeling pad assembly are made of moldable plastic materials. The spines 11 and 12 are made of relatively stiff plastic with ears 25, 26 and 27 of sufficient resiliency to slide over and be retained on the shoulders on pins 21 and 22. The straps 9, shielding member 13 and pins 21 and 22 are made of a flexible rubbery water-resistant elastomer. The cushion members 17 and 18 may be made of resilient dense non-porous closed cell foam material. Tread members 30 and 34 are made of durable non-skid rubber-like material.

Figure 19:
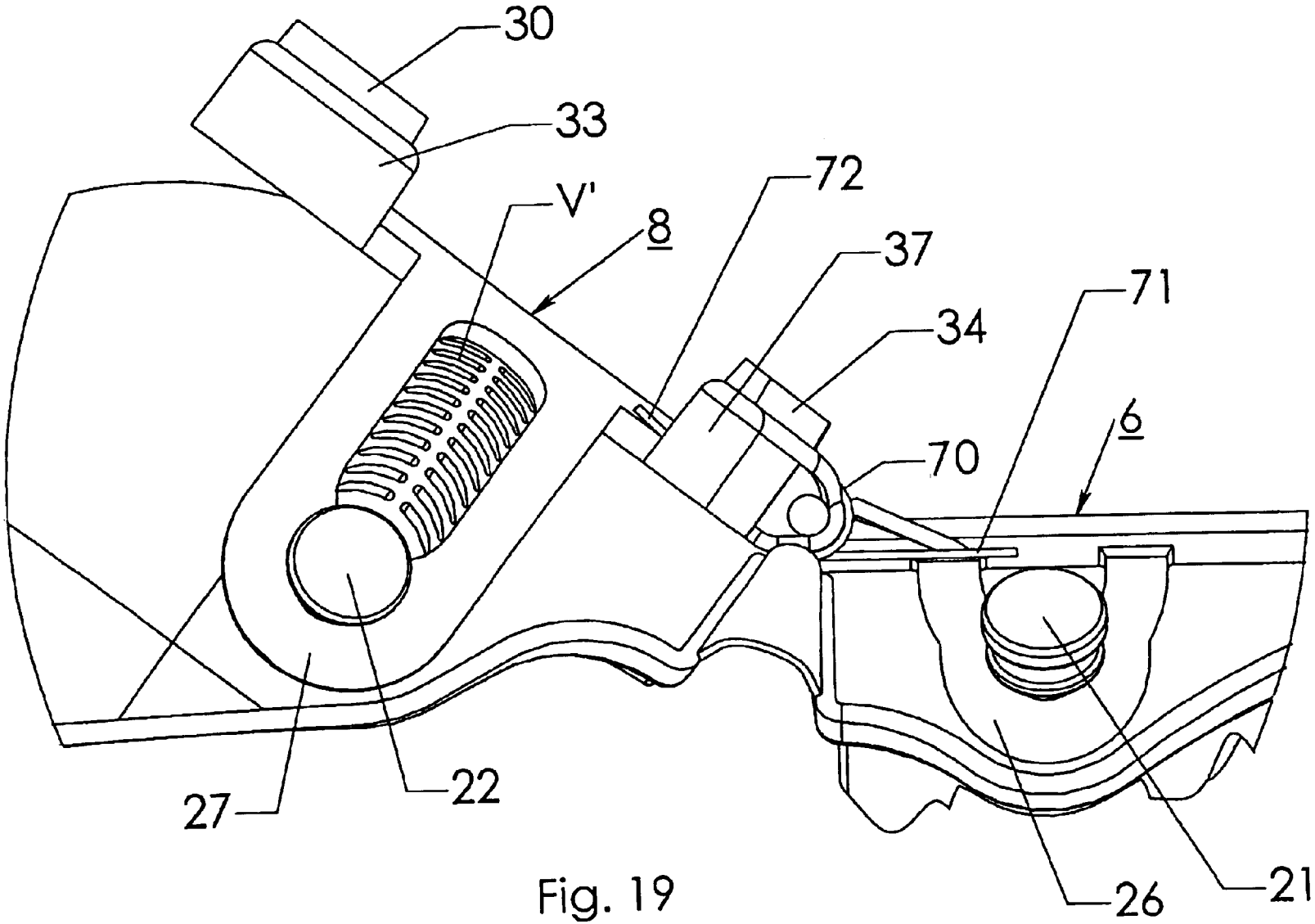
FIG. 19 is a side view of the hinge portion of an alternative embodiment in which a coil spring biases the upper spine to an angled position spaced from the user's knee.

An alternative embodiment shown in FIG. 19 uses a detent as described above to retain the upper spine in its first stable knee engaging position collinear with the lower spine, but utilizes a coil spring 70 coaxial with the hinge pin 7 to bias the upper spine to second stable position angled with respect to the lower spine to keep the upper spine spaced from the knee. Ends 71 and 72 of the coil spring are suitably anchored to the lower and upper assembly structures 6 and 8, respectively. During use, the upper spine may be moved manually or by kneeling from its second stable position to its second stable position. Reverse movement of the upper spine is selectively effected manually or by standing.

Another alternative embodiment (not shown) may be constructed very similar to that of FIG. 19, but utilizes a coil spring coaxial with the hinge pin 7 to bias the upper spine to first stable knee engaging position collinear with the lower spine and utilizing a detent as described to retain the upper spine in its second stable position angled with respect to the lower spine to keep the upper spine spaced from the knee. During use, the upper spine may be moved manually or by standing from its first stable position to its second stable position. Reverse movement of the upper spine is selectively effected manually or by kneeling.

Figure 21:
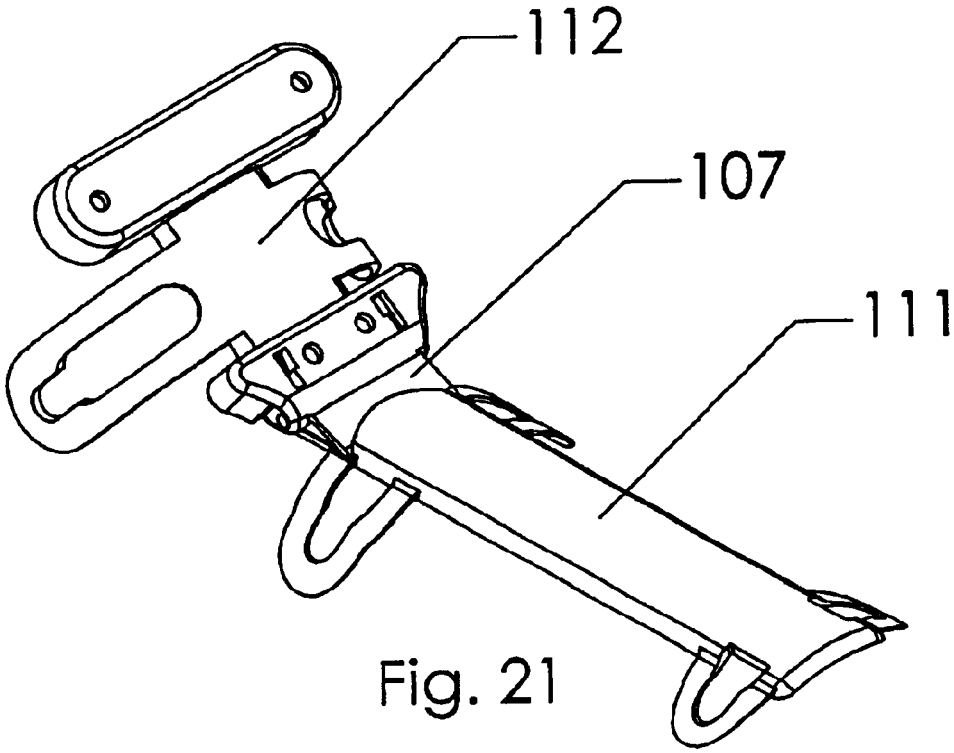
FIG. 21 is a perspective view of FIG. 20.
Figure 22:
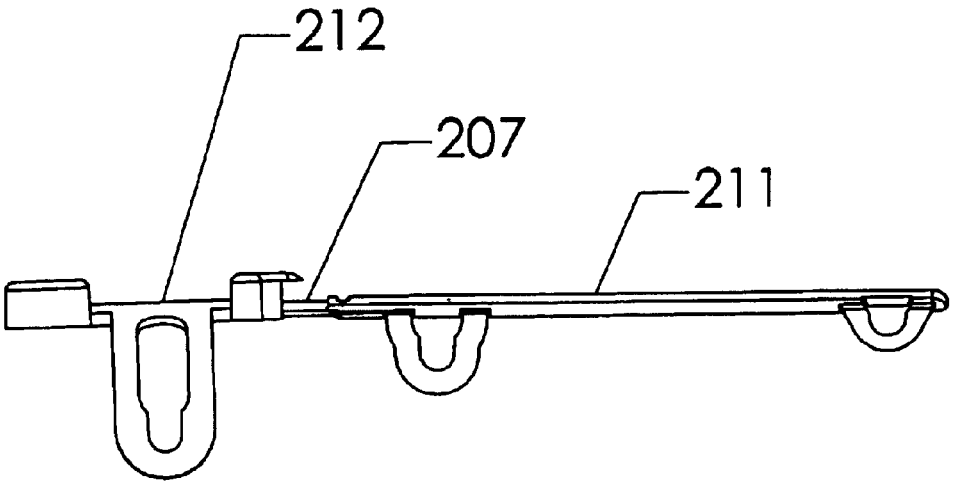
FIG. 22 is a side view of an integrally molded spine structure in which the upper spine portion is biased to a collinear position relative to the lower spine portion by the resilient hinge portion of the integrally molded spine structure which interconnects the upper and lower spine portions.

Another alternative embodiment shown in FIGS. 21–22 uses a detent as described above to retain the upper spine 112 in its first stable knee engaging position collinear with the lower spine 111, but utilizes an integral molded resilient hinge interconnection 107 between theses spines and replacing the hinge pin 7 of prior embodiments to bias the upper spine to second stable position angled with respect to the lower spine to keep the upper spine spaced from the knee. During use, the upper spine may be moved manually or by kneeling from its second stable position to its second stable position. Reverse movement of the upper spine is selectively effected manually or by standing.

Figure 20:
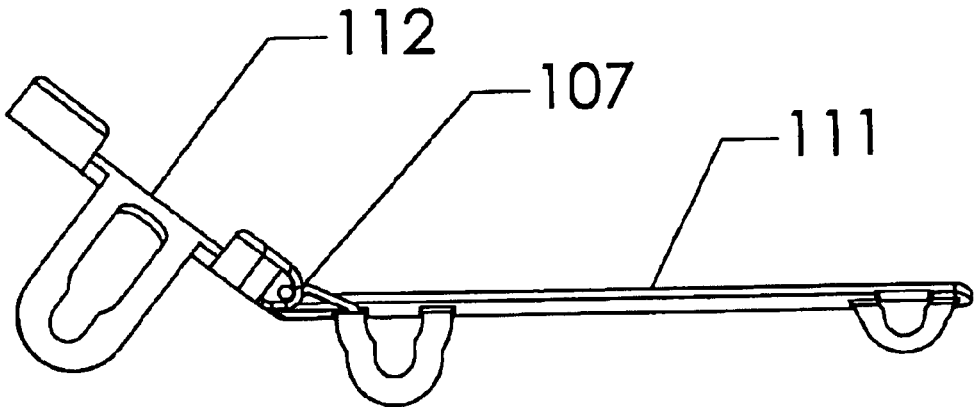
FIG. 20 is a side view of an integrally molded spine structure in which the upper spine portion is biased to an angular position relative to the lower spine portion by the resilient hinge portion of the integrally molded spine structure which interconnects the upper and lower spine portions.
Figure 23:
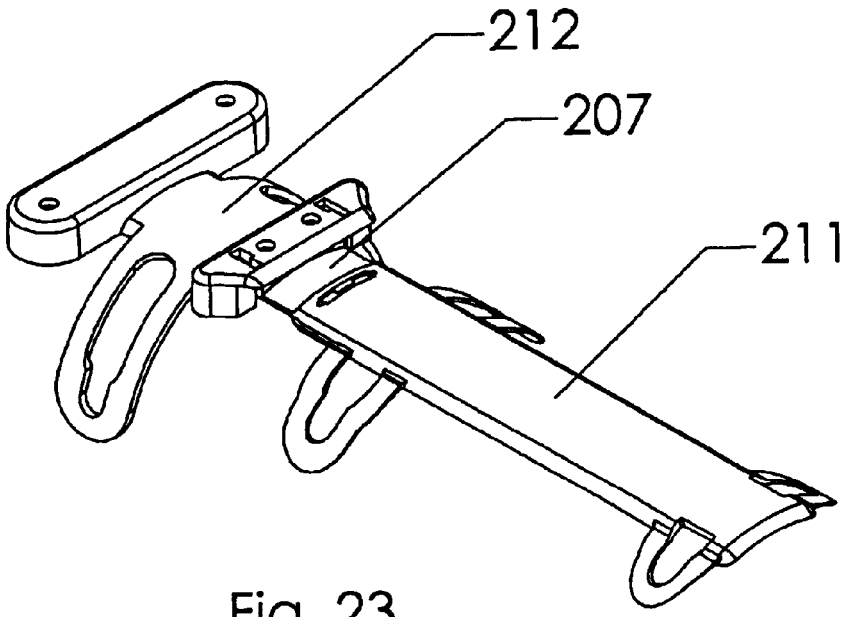
FIG. 23 is a perspective view of FIG. 22.

Another alternative embodiment shown in FIGS. 22–23 is constructed very similar to that of FIGS. 20–21, but utilizes an integral molded resilient hinge interconnection 207 between lower and upper spines members 211 and 212, replacing the binge pin 7 of prior embodiments to bias the upper spine to first stable knee engaging position collinear with the lower spine and utilizing a detent as described above to retain the upper spine in its second stable position angled with respect to the lower spine to keep the upper spine spaced from the knee. During use, the upper spine may be moved manually or by standing from its first stable position to its second stable position. Reverse movement of the upper spine is selectively effected manually or by kneeling.

It will be apparent to one skilled in the art that modifications may be made to the illustrated embodiment without departing from the spirit and scope of the invention as hereinafter defined in the claimed embodiments.

What is claimed is:

1. A kneeling pad assembly comprising:

a supporting spine section including means for securing said spine section at a shin of a user's leg below the user's knee, a cushioned cup section having knee-supporting portions for engaging and underlying the knee of a user when kneeling, articulating means connecting said cup section to said supporting spine section, said articulating means providing means for enabling and guiding movement of said cup section relative to said spine section from a first knee engaging position to a second position spaced from the knee while the spine section is secured to the shin of a user's leg when the user is not kneeling, said articulating means providing means for providing and guiding movement of said cup section relative to said spine section from said second position spaced from the knee to said first knee engaging position when the user moves to a kneeling position while the spine section is secured to the shin of a user's leg, and said cup section being without means for connecting the cup section to the user's leg at or above the user's knee when the cup section is in said second position spaced from the user's knee.

2. A kneeling pad assembly according to claim 1 wherein said articulating means includes a hinge connection means providing angular movement of the cup section relative to said spine section.

3. A kneeling pad assembly according to claim 2 wherein said cup section and said spine section connected by said hinge connection means which provides a hinge axis extending transversely of said supporting spine section below the user's knee.

4. A kneeling pad assembly according to claim 2 wherein said angular movement is limited to an acute angle.

5. A kneeling pad assembly according to claim 1 wherein said articulating means includes detent means providing snap action of said cup section when said cup section moves between said first and second positions.

6. A kneeling pad assembly according to claim 1 wherein the cup section includes means to automatically move it from said first knee engaging position to said second position when the user straightens his leg as in moving from a kneeling position to a standing position.

7. A kneeling pad assembly according to claim 1 wherein said cushioned cup section is a multi-layer section comprising a supporting spine layer, a shielding layer and a knee cushioning layer.

8. A kneeling pad assembly according to claim 7 wherein the layers of the multi-layer section are releasably secured together by manually detachable shouldered pins.

9. A kneeling pad assembly according to claim 6 wherein each of said supporting spine section and said cushioned cup section is a multi-layer section comprising a spine layer, a shielding layer and a cushioning layer, all layers of each multi-layer section being releasably secured together by manually detachable shouldered pins.

10. A kneeling pad assembly according to claim 9 wherein the means for securing said supporting spine section at the shin of a user's leg comprises a pair of elastic straps with openings therein to receive portions of the shouldered pins in said supporting spine section for quick attachment and detachment of the pad assembly relative to the user's leg.

11. A kneeling pad assembly comprising:

a supporting spine section including means for securing said spine section at a shin of a user's leg below the user's knee, a cushioned cup section having knee-supporting portions for engaging and underlying the knee of a user when kneeling, articulating means connecting said cup section to said supporting spine section, said articulating means providing means actuated by the user's leg for enabling and guiding movement of said cup section relative to said spine section from a first position in which the cup section engages the user's knee when the user is kneeling on a supporting surface to a second position spaced from the knee while the spine section is secured to the shin of a user's leg when the user is not kneeling on said surface, said articulating means providing means for providing and guiding movement of said cup section relative to said spine section from said second position spaced from the knee to said first knee engaging position when the user assumes a kneeling position while the spine section is secured to the shin of a user's leg, and said cup section being without means for connecting the cup section to the user's leg at or above the user's knee when the cup section is in said second position spaced from the user's knee.

12. A kneeling pad assembly according to claim 11 wherein said articulating means includes a hinge structure enabling said cup section to move relative to said spine section with a swinging motion between said first and second positions.

13. A kneeling pad assembly according to claim 12 wherein said cushioned cup section is a multi-layer section comprising a supporting spine layer, a shielding layer and a knee cushioning layer.

14. A kneeling pad assembly according to claim 13 wherein the layers of the multi-layer section are releasably secured together by manually detachable shouldered pins.

15. A kneeling pad assembly according to claim 13 wherein said shielding layer of said cup section extends around the top and sides of the user's knee and provides means to automatically move said cup section from said first knee engaging position to said second position when the user straightens his leg as in moving from a kneeling position to a standing position.

16. A kneeling pad assembly comprising:

a supporting spine section including means for securing said spine section in a using position at a shin portion of a user's leg below the user's knee, a cushioned cup section having knee-supporting cushion portions for engaging and underlying the knee of a user when the user is in a kneeling position, cup section supporting means for supporting at least a principal portion of the knee-engaging cup section on and relative to said spine section in a first position in which the cup section is held against and beneath the user's knee when the spine section is in said using position and the user's knee is bent as in said kneeling position, said cup section supporting means providing for movement of the cup section on and relative to said spine section in a second position spaced forward of the user's knee when the spine section is in said using position and the user's knee is straight as when standing.

17. A kneeling pad assembly according to claim 16 wherein the cup section includes means to automatically move it from said first knee engaging position to said second position when the user straightens his leg as in moving from a kneeling position to a standing position.

18. A kneeling pad assembly according to claim 17 wherein said cushioned cup section is a multi-layer section comprising a supporting spine layer, a shielding layer and a knee cushioning layer.

19. A kneeling pad assembly according to claim 18 wherein the layers of the multi-layer section are releasably secured together by manually detachable shouldered pins.

20. A kneeling pad assembly according to claim 19 wherein said supporting spine section and said cushioned cup section are interconnected by a hinge structure.

21. A kneeling pad assembly according to claim 16 wherein each of said supporting spine section and said cushioned cup section is a multi-layer section comprising a spine layer, a shielding layer and a cushioning layer, all layers of the multi-layer sections being releasably secured together by manually detachable shouldered pins, and wherein the means for securing said supporting spine section at the shin of a user's leg comprises a pair of elastic straps with openings therein to receive portions of the shouldered pins in said supporting spine section for quick attachment and detachment of the pad assembly relative to the user's leg.

* * * * *